US007348513B2

(12) United States Patent
Lin

(10) Patent No.: US 7,348,513 B2
(45) Date of Patent: Mar. 25, 2008

(54) MEMBRANE SWITCH

(75) Inventor: Wen-Kuan Lin, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 71 days.

(21) Appl. No.: 11/474,400

(22) Filed: Jun. 26, 2006

(65) Prior Publication Data

US 2007/0144884 A1 Jun. 28, 2007

(30) Foreign Application Priority Data

Dec. 23, 2005 (TW) ..... 94222546 U

(51) Int. Cl.
*H01H 1/10* (2006.01)

(52) U.S. Cl. ..... 200/512

(58) Field of Classification Search ..... 200/512, 200/513–517

See application file for complete search history.

(56) References Cited

U.S. PATENT DOCUMENTS 4,496,812 A * 1/1985 Carley et al. ..... 200/512
6,441,330 B2 * 8/2002 Liao ..... 200/515
6,600,121 B1 7/2003 Olodort et al.
7,112,755 B2 * 9/2006 Kitano et al. ..... 200/511
2002/0179423 A1 * 12/2002 Nozawa et al. ..... 200/517

* cited by examiner

*Primary Examiner*—Elvin Enad
*Assistant Examiner*—Lheiren Mae A. Anglo
(74) *Attorney, Agent, or Firm*—Rosenberg, Klein & Lee

(57) ABSTRACT

A membrane switch solves the problem of requiring a spacing layer or spacers as in the prior art, and includes an upper membrane, a lower membrane. The upper membrane has an upper elastic tongue, an upper hollow portion formed around the upper elastic tongue, and a first conductive trace printed on a top surface of the upper membrane with a first contact formed on the upper elastic tongue. The lower membrane has a lower elastic tongue corresponding to the upper elastic tongue, a lower hollow portion formed around the lower elastic tongue, and a second conductive trace printed on a bottom surface of the lower membrane with a second contact on the lower elastic tongue. The lower elastic tongue penetrates through the upper hollow portion of the upper membrane and elastically extends above the upper elastic tongue. When the lower membrane is depressed, the second contact contacts the first contact.

11 Claims, 8 Drawing Sheets

MEMBRANE SWITCH

BACKGROUND OF THE INVENTION

1. Field of the Invention

The present invention relates to a membrane switch, and in particular to a switch that uses membranes to control whether circuits are on or off and can be applied to, for example, a button switch of any electronic product.

2. Description of Related Art

Membrane switches have been applied widely to key switches of many different electronic products, most notably, keyboards. Each key switch usually includes a key cap and a membrane switch under the key cap. When the key cap is depressed, the membrane switch is conducted to send out a signal.

Reference is made to FIG. 7. A membrane switch 9 of prior art is composed of three membranes, a bottom layer 91, a spacing layer 92, and a top layer 93. The bottom layer 91 is printed with a first conductive trace 912 on its top surface. The top layer 93 is printed with a second conductive trace 932 on its bottom surface. The spacing layer 92 is disposed between the bottom layer 91 and the top layer 93, and is formed with an opening 920. Therefore, the first conductive trace 912 can conduct along with the second conductive trace 932. The disadvantage of this prior art is that three membranes are needed, as can be seen, for example, in U.S. Pat. No. 6,600,121. In particular, the spacing layer 92 is vital to the overall design and does not fulfill industrial and popular trends towards environmental protection.

Reference is made to FIG. 8, in which another membrane switch 8 of prior art is shown. The membrane switch 8 is composed of two membranes, a bottom layer 81 and a top layer 82. The bottom layer 81 is printed with a first conductive trace 812 on its top surface and has a plurality of spacers 814. The spacers 814 are disposed around the first conductive trace 812. The top layer 82 is printed with a second conductive trace 822 at its bottom surface corresponding to the first conductive trace 812. The spacers 814 are used to produce a space between the bottom layer 81 and the top layer 82. This prior art has the disadvantage of needing the spacers 814 which increases costs.

Accordingly, the present invention aims to propose a membrane switch that solves the above-mentioned problems in the prior art.

SUMMARY OF THE INVENTION

An object of the present invention is to provide a membrane switch, which uses only two membranes without a spacing layer or spacers, so that costs and materials are reduced effectively and for fulfilling industrial and popular trends towards environmental protection.

To achieve the object described above, the present invention provides a membrane switch comprising of an upper membrane and a lower membrane. The upper membrane is formed with an upper elastic tongue and an upper hollow portion along a periphery of the upper elastic tongue. The upper membrane is printed with a first conductive trace on a top surface thereof. The first conductive trace extends to the upper elastic tongue. The lower membrane is formed with a lower elastic tongue corresponding to the upper elastic tongue and a lower hollow portion along a periphery of the lower elastic tongue. The lower membrane is printed with a second conductive trace on a bottom surface thereof. The second conductive trace extends to the lower elastic tongue. The lower elastic tongue passes through the upper hollow portion of the upper membrane and elastically extends above the upper elastic tongue. When a user depresses the lower membrane, the second conductive trace of the lower membrane contacts the first conductive trace of the upper membrane.

Compared with the prior art, the present invention requires only two membranes. A spacing layer or spacers are unnecessary. Costs and materials are thereby effectively reduced and for fulfilling industrial and popular trends towards environmental protection. Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

Figure 1:
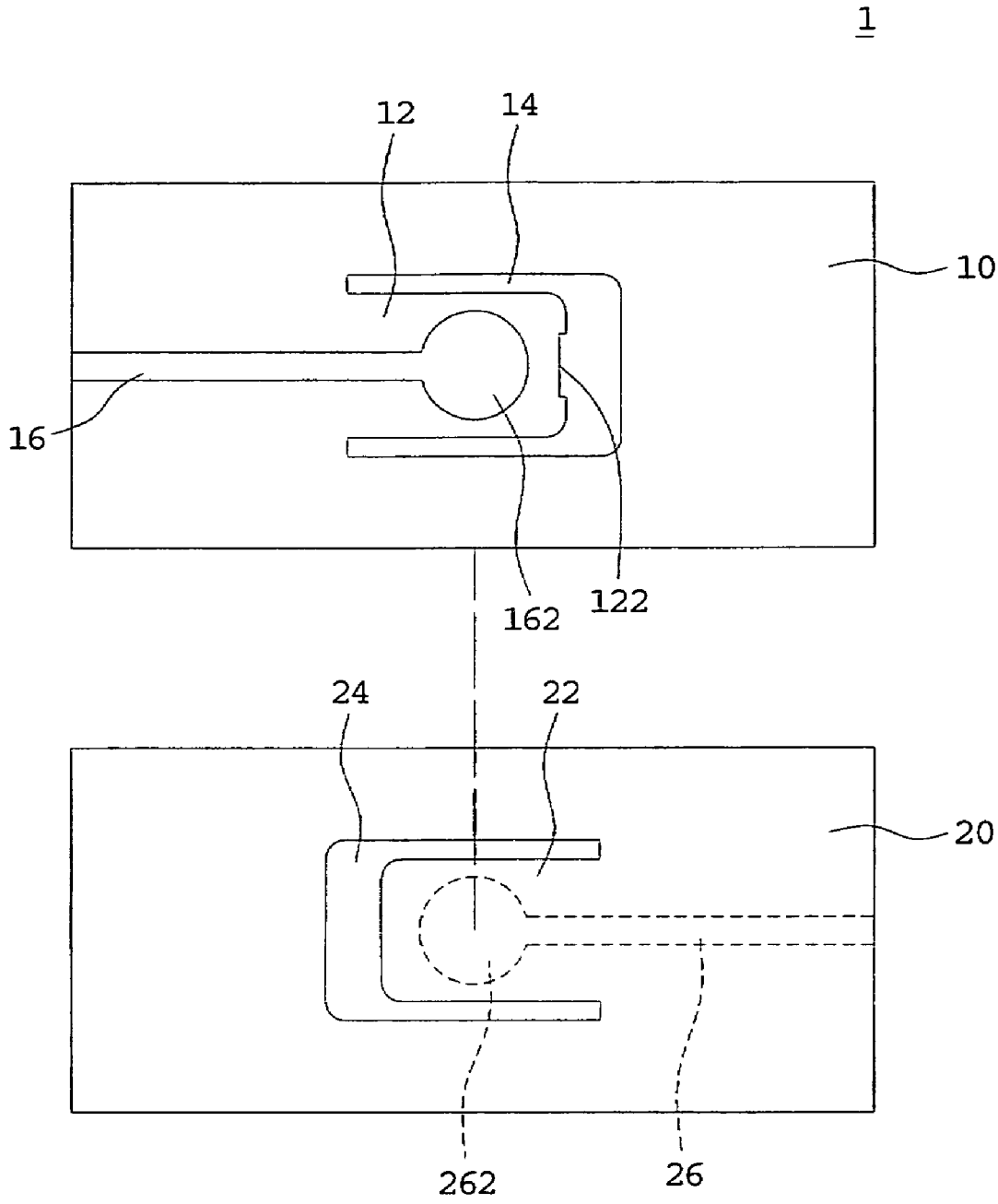
FIG. 1 is an exploded top view of a membrane switch according to the present invention.

Reference is made to FIG. 1, which is an exploded top view of a membrane switch according to the present invention. The present invention provides a membrane switch 1 including an upper flexible membrane 10 and a lower flexible membrane 20. The upper membrane 10 and the lower membrane 20 are made of insulated material, such as Polyethylene Terephthalate (PET). PET is a kind of thermo plastic polyester elastomer, which has characteristics of heat resistance, good insulation, and is highly transparent.

The upper membrane 10 and the lower membrane 20 of the present invention can be made via plastic injection technology. PET can be strengthened by adding fiberglass and/or a mineral substance. When PET is mixed with a strengthening material, it greatly enhances the strength, rigidity, and heat resistance of PET.

The upper membrane 10 of the present invention is formed with an upper elastic tongue 12 and an upper hollow portion 14. The upper hollow portion 14 is formed around a periphery of the upper elastic tongue 12. A conductive first conductive trace 16 is printed on a top surface of the upper membrane 10. The first conductive trace 16 forms a first contact 162 on the upper elastic tongue 12. The first conductive trace 16 can be printed by conductive material, such as silver paste.

The lower membrane 20 is formed with a lower elastic tongue 22 corresponding to the upper elastic tongue 12 and the lower elastic tongue 22 partially surrounded by a lower hollow portion 24. The lower hollow portion 24 is U-shaped along a periphery of the lower hollow portion 24. The lower surface of the lower membrane 20 is also printed with a second conductive trace 26. The second conductive trace 26 forms a second contact 262 on the lower elastic tongue 20.

The upper membrane 10 and the lower membrane 20 of the present invention have the same structure, and respectively have a hollow portion and a printed conductive trace. In this preferred embodiment, the upper hollow portion 14 and the lower hollow portion 24 are U-shaped. The upper elastic tongue 12 and the lower elastic tongue 22 are rectangular. The upper elastic tongue 12 is formed with a cutout 122 at its free end. The cutout 122 corresponds to the second conductive trace 26 of the lower elastic tongue 22. When the present invention is assembled, the second conductive trace 26 of the lower membrane 20 is located in the cutout 122 of the upper elastic tongue 12. The second conductive trace 26 is then prevented from being rubbed and ruined by the edge of the free end of the upper elastic tongue 12.

The manufacturing method of the present invention includes: providing the upper membrane 10 and the lower membrane 20; printing the first and second conductive traces 16, 26 respectively on the upper membrane 10 and the lower membrane 20; punching the upper membrane 10 and the lower membrane 20 to respectively form the upper hollow portion 14, the lower hollow portion 24, the upper elastic tongue 12, and the lower elastic tongue 22. Alternatively, the upper hollow portion 14 and the lower hollow portion 24 can be simultaneously formed while the upper membrane 10 and the lower membrane 20 are injected.

Figure 2:
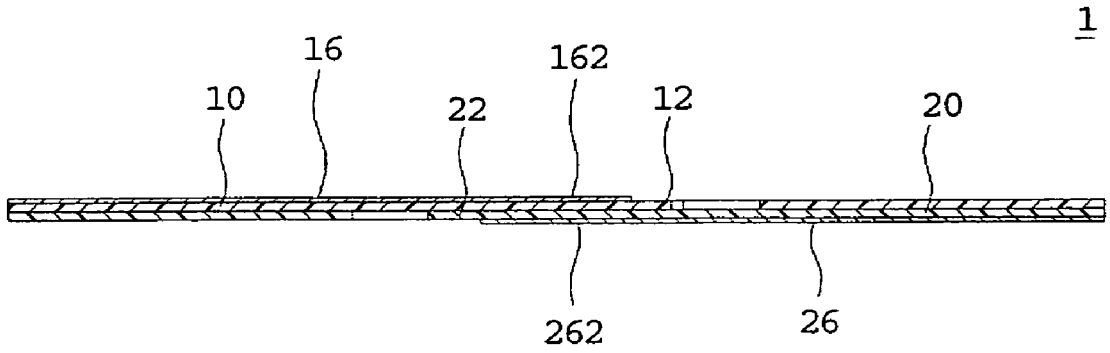
FIG. 2 is a cross-sectional side view of a membrane switch before assembly according to the present invention.
Figure 3:
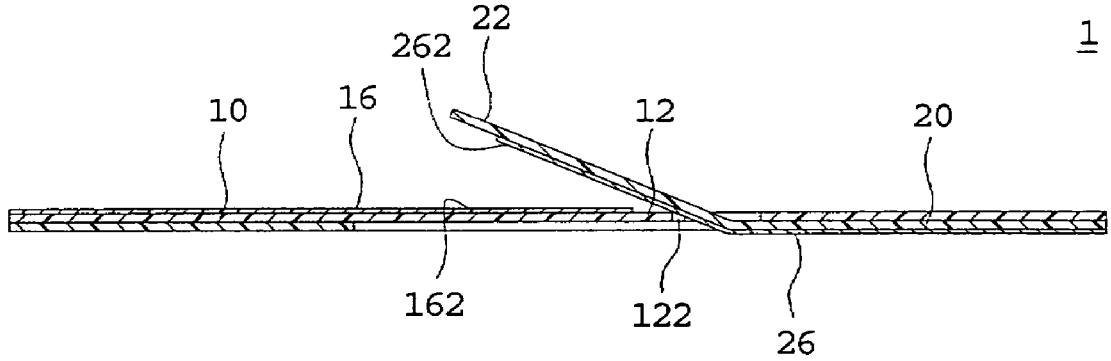
FIG. 3 is a cross-sectional side view of a membrane switch after assembly according to the present invention.

Reference is made to FIGS. 2 and 3, which are cross-sectional side views of a membrane switch before and after assembled according to the present invention. The surfaces of both the upper membrane 10 and the lower membrane 20 lack printed conductive traces thereon are defined as back surfaces thereof. When assembling, the upper membrane 10 and the lower membrane 20 are arranged back to back so that they are insulated. The surface of the upper membrane 10 printed with the first conductive trace 16 faces upward and is defined as a top surface. The surface of the lower membrane 20 printed with the second conductive trace 26 faces downward and is defined as a bottom surface. The free ends of the upper elastic tongue 12 and the lower elastic tongue 22 are defined as front ends, the upper elastic tongue 12 opposite to the lower elastic tongue 22.

Figure 3A:
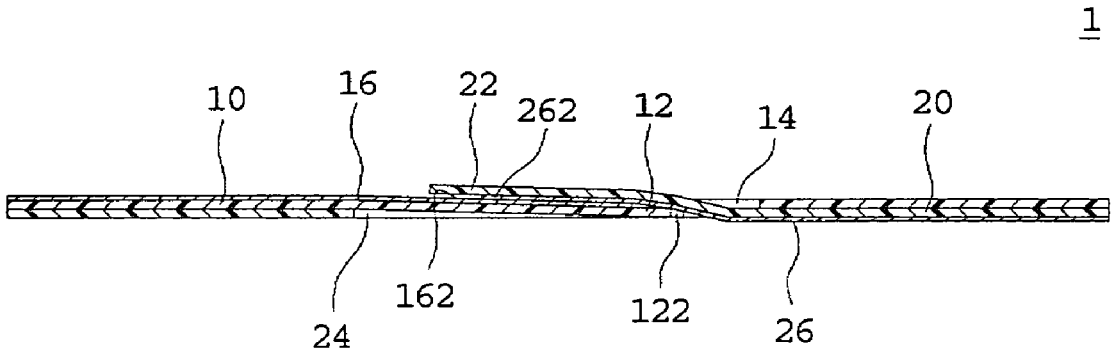
FIG. 3A is a cross-sectional side view of a membrane switch in a conductive condition according to the present invention.

Next, the lower elastic tongue 22 is propped up and passed through the upper hollow portion 14 of the upper membrane 10. The lower elastic tongue 22 extends elastically above the upper elastic tongue 12. Reference is made to FIG. 3A. When the lower elastic tongue 22 is depressed, the second contact 262 on the bottom surface of the lower elastic tongue 22 is moved downward and contacts the first contact 162 on the top surface of the upper elastic tongue 12. In this embodiment, the first contact 162 and the second contact 262 are mutually overlapping. The membrane switch 1 of the present invention is thereby achieved.

Figure 4:
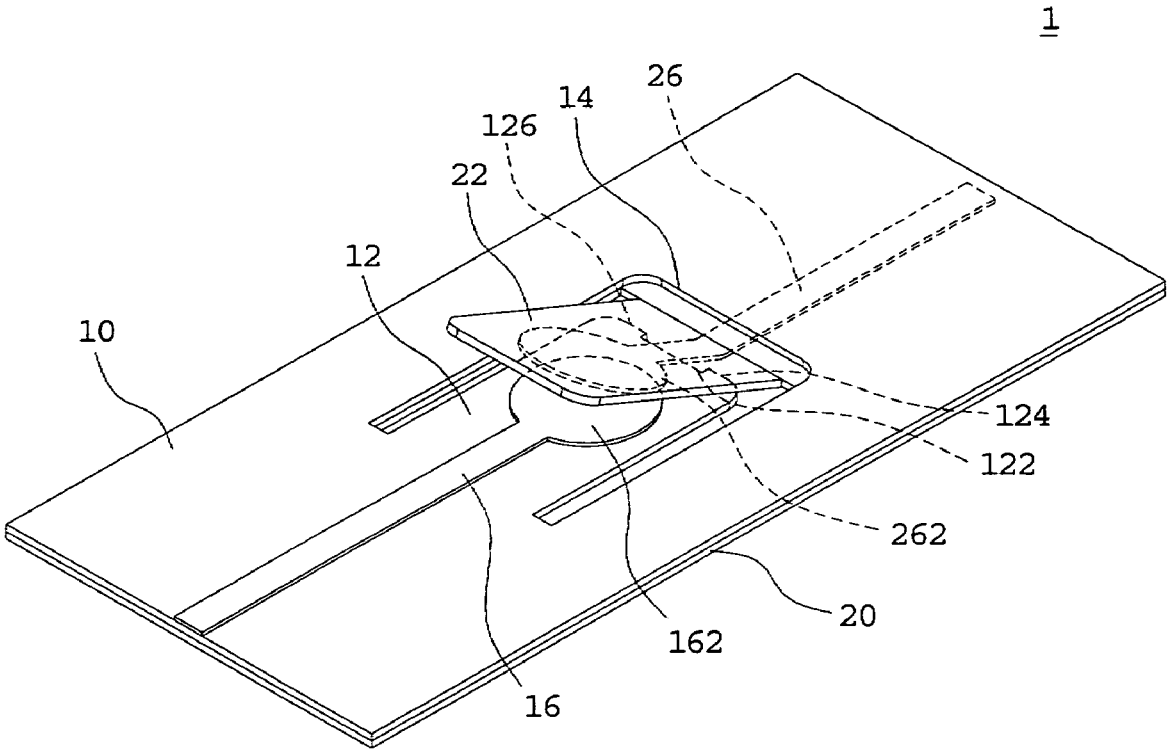
FIG. 4 is an assembled perspective view of a membrane switch according to the present invention.

Reference is made to FIG. 4, which is an assembled perspective view of a membrane switch according to the present invention. The upper elastic tongue 12 of the present invention is formed with the cutout 122 at its free end (or front end). Two front edges 124, 126 at two sides of the free end of the upper elastic tongue 12 abut against the lower elastic tongue 22. At this stage, the lower elastic tongue 22 is propped up by the upper elastic tongue 12 and forms an oblique angle. When the lower elastic tongue 22 is depressed, the second contact 262 contacts the first contact 162. When the pressing force disappears, the lower elastic tongue 22 comes back to the original position, and then the second contact 262 no longer contacts the first contact 162.

The upper elastic tongue 12 and the lower elastic tongue 22 frequently rub against each other, especially where the front edges 124, 126 of the upper elastic tongue 12 are abutted against the lower elastic tongue 22. This embodiment provides the cutout 122 at the free end of the upper elastic tongue 12 corresponding to the second conductive trace 26 of the lower elastic tongue 22, so that the second conductive trace 26 of the lower elastic tongue 22 is located in the cutout 122. The second conductive trace 26 of the present invention can be prevented from being rubbed and scraped because of the frequent rubbing between the upper elastic tongue 12 and the lower elastic tongue 22, which thereby lengthens user life.

Figure 5:
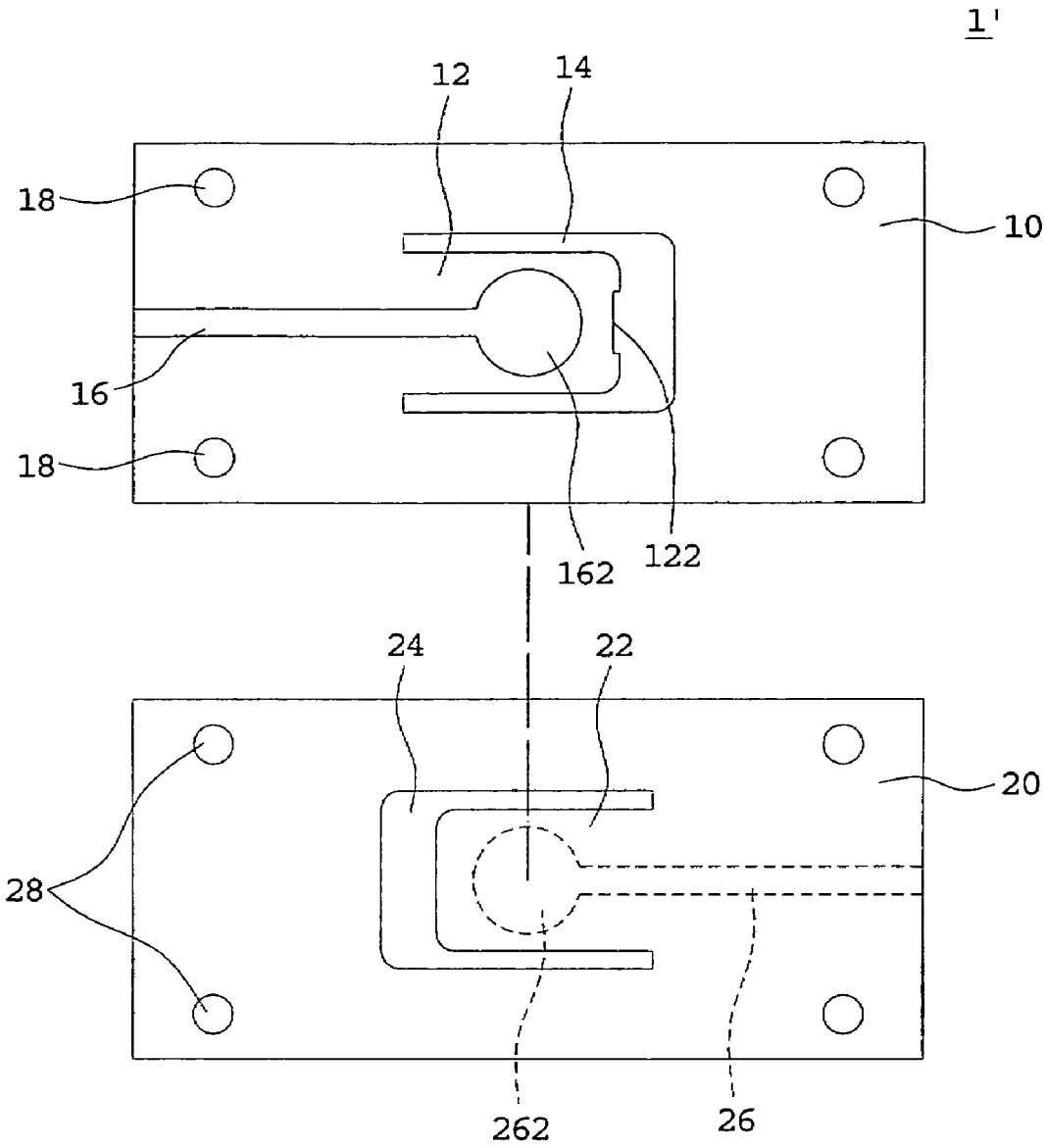
FIG. 5 is an exploded top view of a membrane switch of another embodiment according to the present invention.
Figure 6:
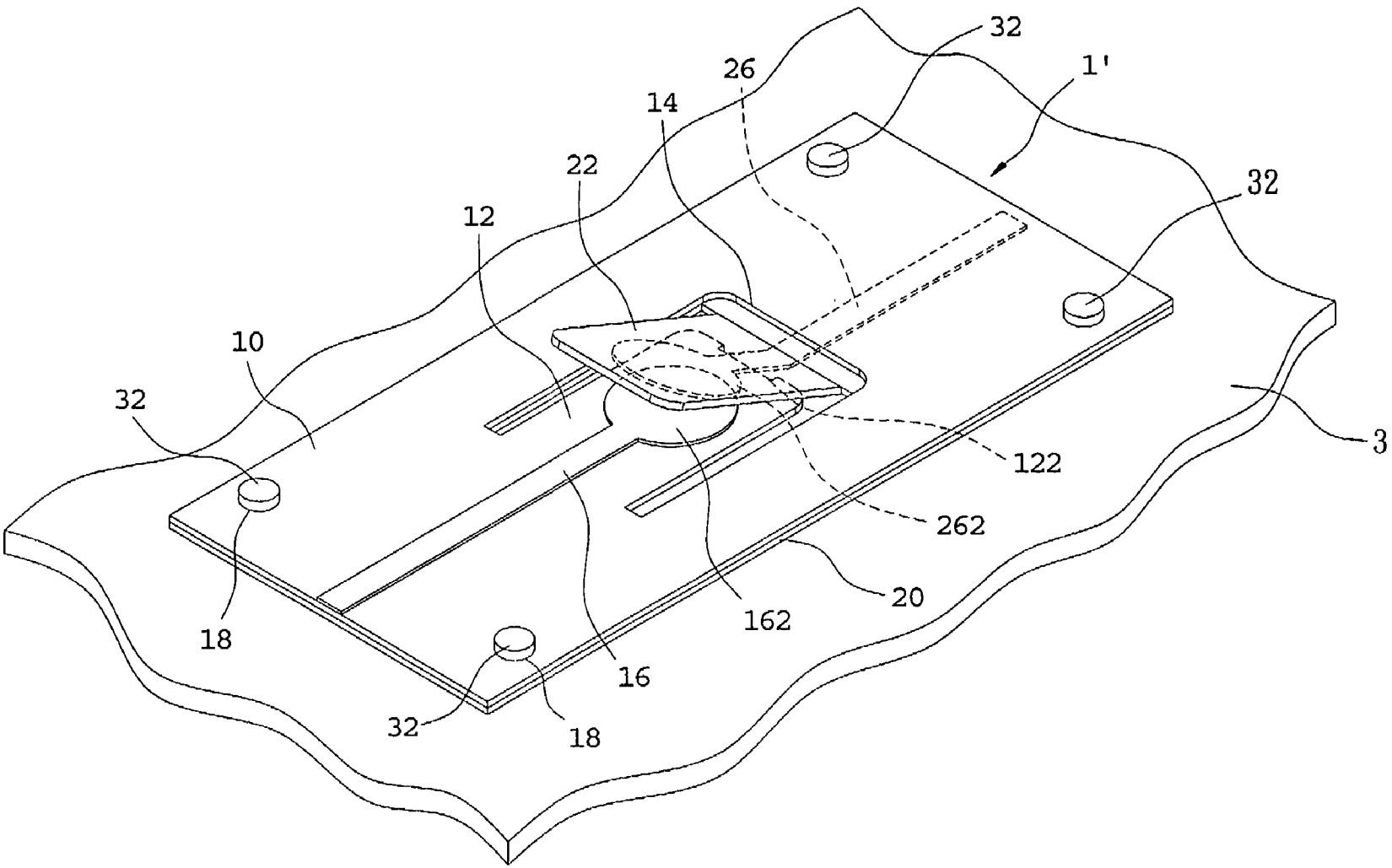
FIG. 6 is an assembled perspective view of a membrane switch of another embodiment according to the present invention.
Figure 7:
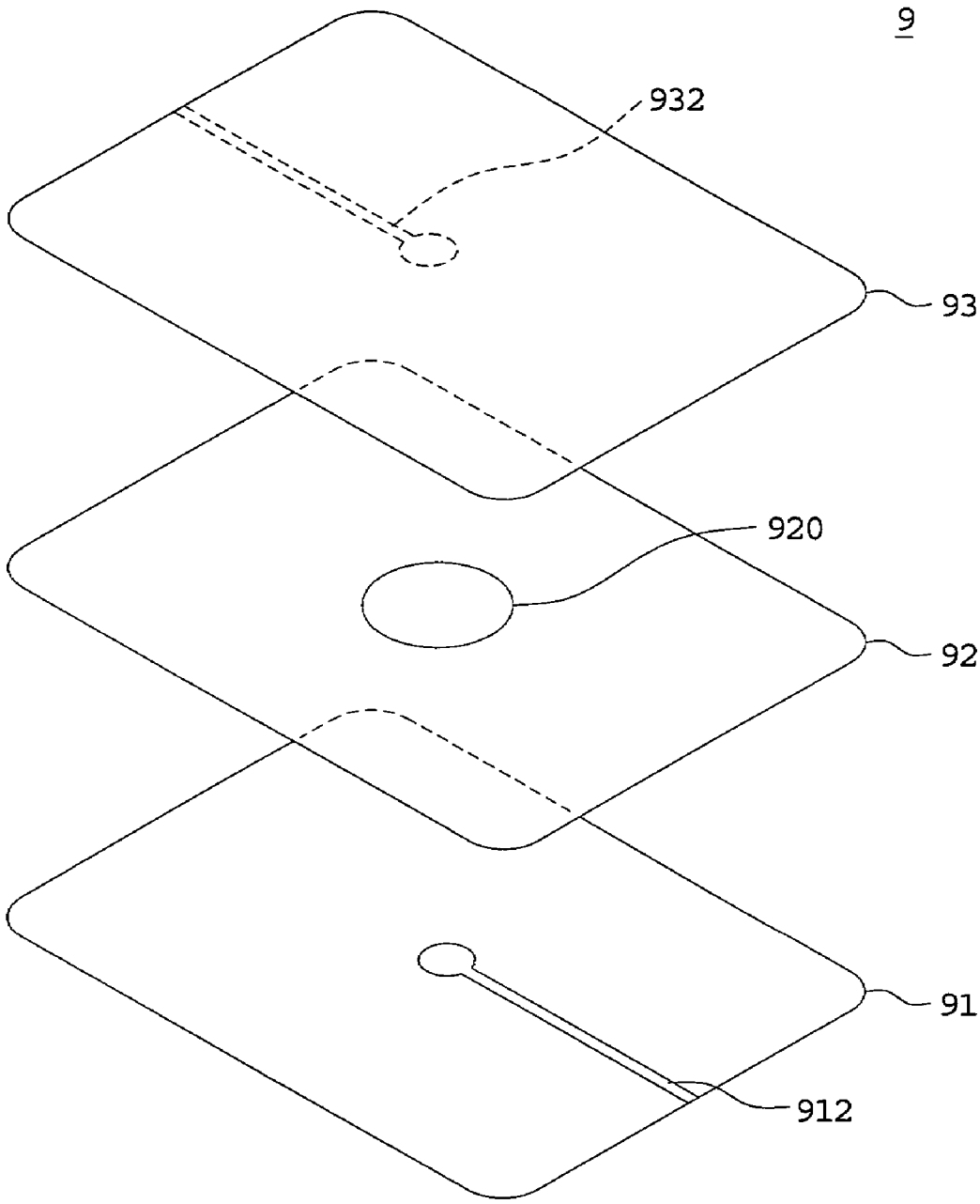
FIG. 7 PRIOR ART
FIG. 7 is an exploded perspective view of a membrane switch of prior art.
Figure 8:
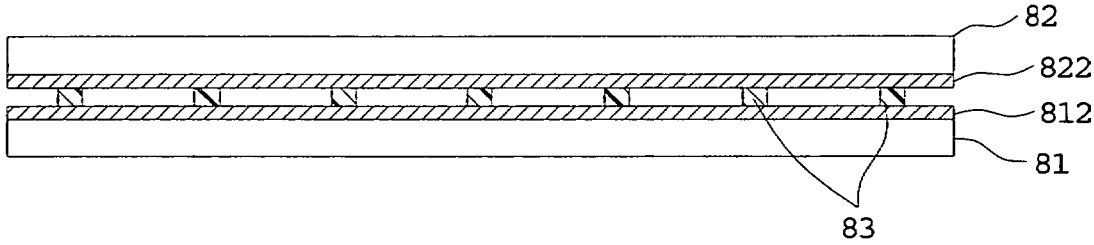
FIG. 8 PRIOR ART
FIG. 8 is a cross-sectional side view of a membrane switch of another prior art.

Reference is made to FIGS. 5 and 6, which are an exploded top view and an assembled perspective view of a membrane switch of another embodiment according to the present invention. The membrane switch 1' in this embodiment, the upper elastic tongue 12, and the lower elastic tongue 22 are respectively formed with four orientating elements 18, 28. The four orientating elements 18, 28 provide reference points of orientation for assembling the upper membrane 10 and the lower membrane 20, and thus make assembly of the switch faster and more convenient.

The orientating elements 18, 28 can be through holes. When the through holes are mutually overlapped, the membrane switch 1' can be fixed on a base board 3. The base board 3 has a plurality of posts 32 corresponding to the through holes for passing the through holes.

The membrane switch of the present invention is expressed as a single switch. In application, there can be a plurality of upper elastic tongues and lower elastic tongues formed respectively on the upper membrane and the lower membrane. It provides a plurality of membrane switches and can be applied in a number of ways, such as to a keyboard.

As described above, the present invention has the following advantages:

1. The membrane switch of the present invention only requires two membranes, and it can achieve the same effectiveness whilst lacking a spacing layer or a spacer which was necessary in the prior art. It needs fewer materials and fulfills the requirements of environmental protection.

2. The membrane switch of the present invention utilizes the rigidity of the membrane itself, and the elastic tongue that is formed by punching has elasticity thereby providing a recovering force.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A membrane switch, comprising:

an upper membrane, formed with an upper elastic tongue and an upper hollow portion along a periphery of said upper elastic tongue, said upper membrane printed with a first conductive trace on a top surface thereof, said first conductive trace extending to said upper elastic tongue; and a lower membrane, formed with a lower elastic tongue corresponding to said upper elastic tongue and a lower hollow portion along a periphery of said lower elastic tongue, said lower membrane is printed with a second conductive trace on a bottom surface thereof, said second conductive trace extends to said lower elastic tongue, wherein said lower elastic tongue passes through said upper hollow portion of said upper membrane and is elastically extended above said upper elastic tongue, whereby when said lower membrane is depressed, said second conductive trace of said lower membrane contacts said first conductive trace of said upper membrane.

2. The membrane switch as claimed in claim 1, wherein said upper membrane and said lower membrane are made of an insulated material.

3. The membrane switch as claimed in claim 2, wherein said insulated material is Polyethylene Terephthalate (PET) and is mixed with a strengthening material.

4. The membrane switch as claimed in claim 3, wherein said strengthening material is fiberglass or a mineral substance.

5. The membrane switch as claimed in claim 1, wherein said upper hollow portion and said lower hollow portion are U-shaped.

6. The membrane switch as claimed in claim 1, wherein said first conductive trace of said upper membrane is formed with a first contact on said upper elastic tongue, said second conductive trace of said lower membrane is formed with a second contact on said lower elastic tongue, when said lower membrane is depressed, said first contact contacts said second contact.

7. The membrane switch as claimed in claim 6, wherein said first contact and said second contact are mutually overlapped.

8. The membrane switch as claimed in claim 1, wherein said upper elastic tongue is formed with a cutout at a free end thereof, said second conductive trace of said lower elastic tongue is disposed within said cutout, the free end of said upper elastic tongue forms two front edges at two sides of said cutout and abuts against said lower elastic tongue.

9. The membrane switch as claimed in claim 1, wherein said lower elastic tongue extends above said upper elastic tongue and is oblique relative to said upper elastic tongue.

10. The membrane switch as claimed in claim 1, wherein said upper elastic tongue and said lower elastic tongue are respectively formed with at least one orientating element.

11. The membrane switch as claimed in claim 10, further comprising a base board, said base board having a plurality of posts, said orientating elements being through holes, said posts passing through said corresponding holes.

* * * * *